US005307946A

United States Patent [19]

Molinaro

[11] Patent Number: 5,307,946

[45] Date of Patent: May 3, 1994

[54] NECK FINISH FOR A CONTAINER AND A MATCHING REGISTERING MULTIPLE THREAD PATTERN IN A FLEXIBLE CAP FOR ENGAGEMENT ON NECK SAID FINISH

[75] Inventor: Luca Molinaro, New Castle, Pa.

[73] Assignee: Northern Engineering & Plastics, Corp., New Castle, Pa.

[21] Appl. No.: 36,277

[22] Filed: Mar. 24, 1993

[51] Int. Cl.[5] ..... B65D 41/34

[52] U.S. Cl. ..... 215/329; 215/256; 215/318; 215/330; 220/288; 220/296

[58] Field of Search ..... 215/256, 252, 329, 332, 215/330, 331, 318; 220/296, 288, 293

[56] References Cited

U.S. PATENT DOCUMENTS

| | | | |
|---|---|---|---|
| 1,443,682 | 1/1923 | Gueritey | 220/296 |
| 2,162,711 | 6/1939 | Hamberger . | |
| 2,162,712 | 6/1939 | Hamberger . | |
| 3,650,428 | 3/1972 | Miller . | |
| 3,885,696 | 5/1975 | Eberhardt | 220/288 X |
| 3,980,195 | 9/1975 | Fillmore . | |
| 4,298,129 | 11/1981 | Stull | 215/318 X |
| 4,354,609 | 10/1982 | Hidding . | |
| 4,389,561 | 5/1986 | Crisci . | |
| 4,402,415 | 9/1983 | Hopley . | |
| 4,418,828 | 12/1983 | Wilde et al. . | |
| 4,497,765 | 2/1985 | Wilde et al. . | |
| 4,534,480 | 8/1985 | Santostasi et al. . | |
| 4,561,553 | 12/1985 | Crisci . | |
| 4,666,053 | 5/1987 | Corcoran et al. . | |
| 4,852,774 | 8/1989 | Crawford | 220/296 X |
| 5,004,114 | 4/1991 | Terbrusch et al. | 220/296 |
| 5,213,224 | 5/1993 | Luch | 215/318 X |

*Primary Examiner*—Allan N. Shoap
*Assistant Examiner*—Vanessa Caretto
*Attorney, Agent, or Firm*—Harpman & Harpman

[57] ABSTRACT

A blow molded container has a cylindrical neck portion with novel seven circumferentially spaced continuous spiral thread configurations on its exterior to immediately receive and engage an improved tamper indicating flexible cap comprising a top with an annular depending wall on its peripheral edge and seven circumferentially spaced continuous spiral thread configurations on the inner surface surface of the annular depending wall. The novel constructions enable the tamper indicating flexible cap to immediately engage the lead-in ends of the seven circumferentially spaced thread patterns on the exterior of the neck of the container without the heretofore necessary rotation of the prior art caps in order to engage the single spiral thread configuration on the neck of the container.

5 Claims, 2 Drawing Sheets

NECK FINISH FOR A CONTAINER AND A MATCHING REGISTERING MULTIPLE THREAD PATTERN IN A FLEXIBLE CAP FOR ENGAGEMENT ON NECK SAID FINISH

BACKGROUND OF THE INVENTION

1. Technical Field

This invention relates to containers such as blow molded plastic jugs which are widely used in the dairy industry and others for the expendible packaging of dairy products and other liquids and tamper indicating caps for engagement thereon.

2. Description of the Prior Art

Prior neck finishes on containers of this type may be seen in U.S. Pat. Nos. 2,162,711 of June, 1939, 2,162,712 of June, 1939, 3,650,428 of Mar. 21, 1972, 3,980,195 of Sep. 14, 1976, 4,354,609 of Oct. 19, 1982, 4,402,415 of Sep. 6, 1983, 4,418,828 of Dec. 6, 1984, 4,497,765 of Feb. 5, 1985, 4,534,480 of Aug. 13, 1985 and 4,561,553 of Dec. 31, 1985.

In each of the above U.S. patents there are individual neck spiral thread configurations which require a cap with a matching single spiral thread configuration for engagement thereon and have the common fault of requiring selective testing rotation of the cap on the threaded neck of the container before the single thread patterns engage.

Additionally, partial semi-annular thread patterns comprising ribs are disclosed in U.S. Pat. Nos. 4,589,561 of May, 1986 and 4,666,053 of May 19, 1987.

In the '561 patent several short angular ribs are circumferentially spaced on the inner surface of the depending annular wall of a cap and in the '053 patent a pair of vertically spaced short annularly disposed ribs are disclosed on the neck finish of a container.

The present invention provides an improved novel neck finish for a container such as a blow molded plastic jug on which a multiple spiral thread pattern configuration of continuous spiral threads are arranged in vertical and circumferentially spaced relation to one another together with a thin wall plastic cap that may be pushed onto the container, the cap having a top and a depending annular wall with a multiple annular spiral thread patterns circumferentially and vertically spaced formed on the inner surface of said depending wall of the improved cap. The combination of the improved cap and improved neck finish of the container result in a rapid and positive engagement of the multiple continuous spiral thread patterns on the respective neck finish with those on the inner surface of the depending wall of the cap.

SUMMARY OF THE INVENTION

A novel neck finish on a container such as a blow molded plastic jug forms multiple continuous spiral thread patterns as the neck finish, the thread patterns being circumferentially spaced with respect to beginning and end and presenting multiple lead-in thread configurations adjacent the top of the blow molded container and its neck finish such as seven lead-in points circumferentially spaced with respect to one another and each point comprising the upper lead-in end of a continuous spiral thread formed on the neck finish and terminating on the lowermost portion of the cylindrical portion of the blow molded jug or container. The matching cap has registering multiple thread patterns spaced vertically and horizontally so that as for example seven lead-in ends of seven continuous spiral threads on the neck finish of the container will readily and quickly engage multiple circumferentially spaced areas between the ends of seven circumferentially spaced continuous spiral thread patterns extending from adjacent the inner surface of the top of the cap to radially spaced positions near the bottom of the depending annular wall of the cap. Substantially improved application of the caps to the neck finishes of the containers is achieved as well as very substantially increased liquid sealing engagement between the multiple continuous spiral thread patterns on the container neck finish and on the inner surface of the depending wall of the improved cap.

DESCRIPTION OF THE PREFERRED EMBODIMENT

Figure 1:
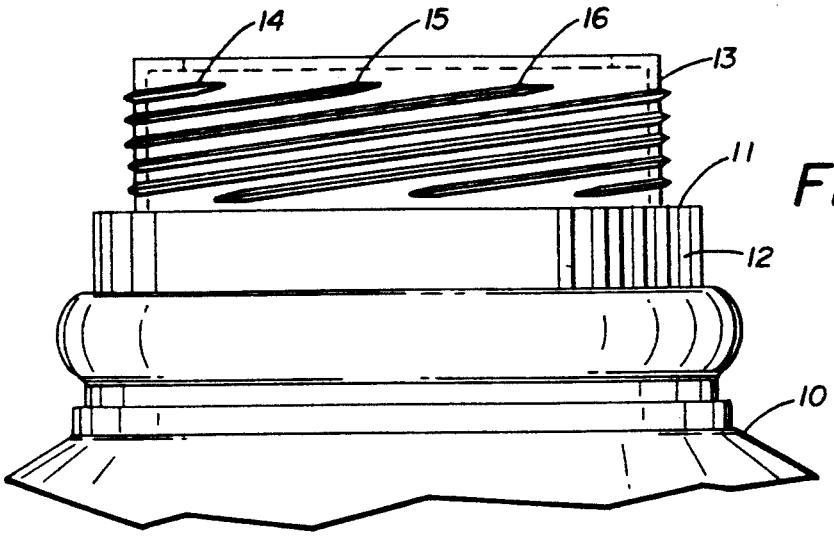
FIG. 1 is a side elevation of a portion of a container, such as a blow molded jug, with a cylindrical neck finish comprising the upper portion thereof and having the multiple horizontally and vertically spaced continuous spiral thread configurations thereon.

By referring to the drawings and FIG. 1 in particular it will be seen that a portion of a blow molded jug or the like 10 has a neck 11 of a first diameter including at least two groups of vertical fastening configurations 12 spaced circumferentially thereon. The neck of the container above the portion 12 is a cylindrical portion 13 with a plurality, preferably seven, horizontally and vertically spaced continuous annular spiral threads 14, 15, and 16 as seen in FIG. 1 of the drawings and by referring to FIG. 2 of the drawings, the upper horizontally spaced ends of the remaining continuous annular spiral threads are indicated by the numerals 17, 18, 19 and 20.

Figure 2:
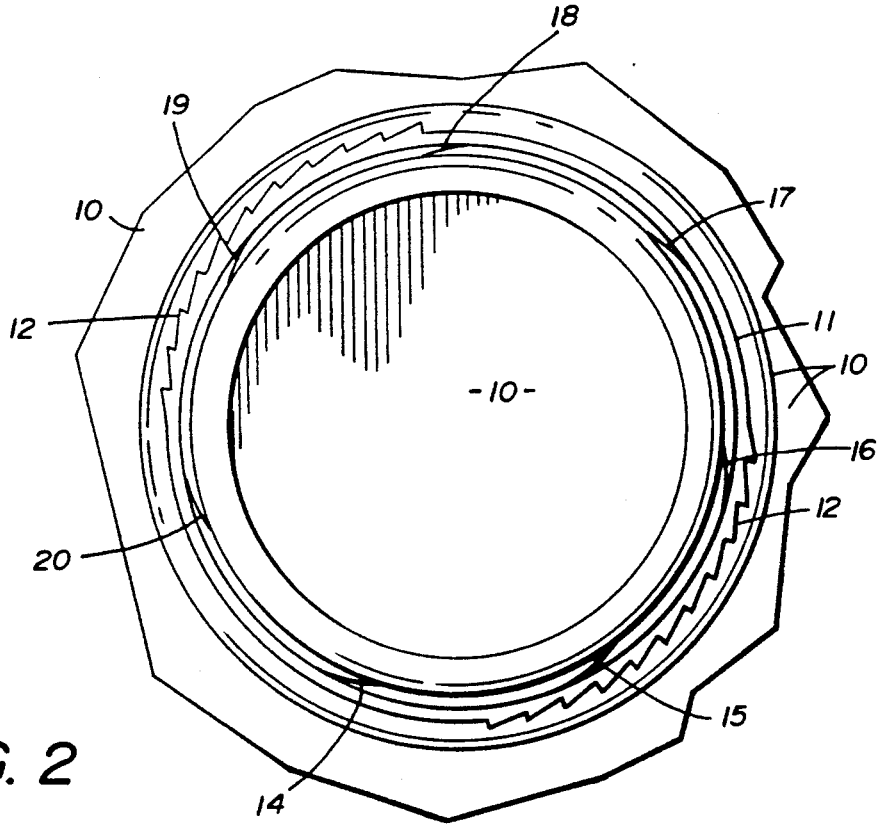
FIG. 2 is a top plan view of the blow molded container of FIG. 1 illustrating the preferred seven lead-in circumferentially spaced ends of the seven continuous spiral threads comprising the neck finish.

Still referring to FIGS. 1 and 2 of the drawings, it will be seen that each of the vertically and horizontally spaced continuous annular spiral threads 14, 15, 16, 17, 18, 19 and 20 extend continuously for more than a complete spiral circle before terminating on the cylindrical neck portion 13 in spaced relation to the upper surface of the portion 11 of the neck finish.

By referring now to FIG. 2 of the drawings, it will be seen that the top plan view of the neck finish of FIG. 1 illustrates the lead-in ends of the seven circumferentially and vertically spaced continuous annular spiral threads 14 through 20 respectively and wherein the lead-in ends as shown in FIG. 2 of the drawings are spaced circumferentially with respect to one another continuously around the neck finish of the tubular portion of the neck 13.

Additionally in FIG. 2 the vertical fastening configurations 12 may be seen to comprise two groups of ratchet teeth which are preferably positioned on the opposite sides of the threaded neck 13 although other groupings of the vertical fastening configurations 12 may be used if desired.

Figure 3:
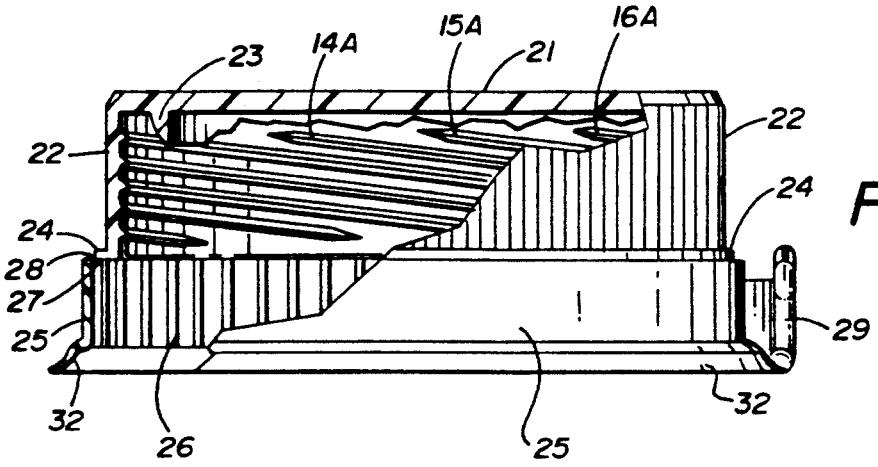
FIG. 3 is a side elevation with parts broken away illustrating an improved cap with vertically and horizontally spaced multiple raised continuous thread patterns on the inner surface of the depending annular wall of the cap for matching engagement with the improved neck finish of FIGS. 1 and 2 of the drawings.
Figure 4:
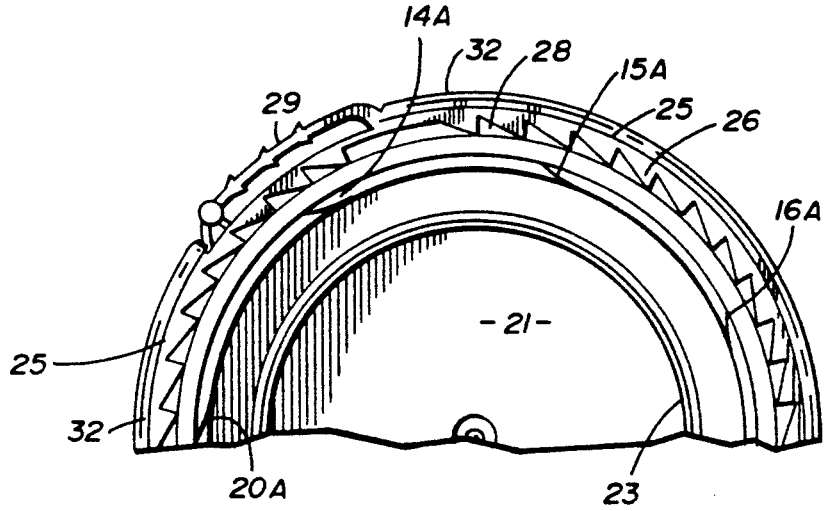
FIG. 4 is a partial bottom view of the improved thin wall plastic cap of FIG. 3 of the drawings.

By referring now to FIG. 3 of the drawings, multiple thread patterns 14A through 20A in the flexible cap register with the circumferentially and vertically spaced multiple thread patterns hereinbefore described in connection with FIGS. 1 and 2 of the drawings may be seen and by referring thereto it will be seen that the cap comprises a top portion 21 having an annular depending wall 22 integrally joined to the peripheral edge of the top 21. The cap is provided with a downturned annular sealing flange 23 depending from the bottom of the top 21 of the cap and the bottom edge of the depending annular wall 22 comprises a narrow outturned rib 24. A tear skirt 25 of a slightly larger diameter than the rib 24 is formed with its inner surface having a continuous ratchet tooth configuration 26, the innermost upper corners of each of the ratchet teeth 26 comprise connecting members 27 by which the tear skirt 25 is integrally attached to the lower peripheral edge of the narrow outturned rib 24. It will be seen that the innermost upper corners of each of the ratchet teeth 26 which comprise the connecting members 27 are spaced circumferentially so as to leave a plurality of openings 28 that also appear in the left hand portion of the cap as seen in FIG. 5 of the drawings.

Figure 5:
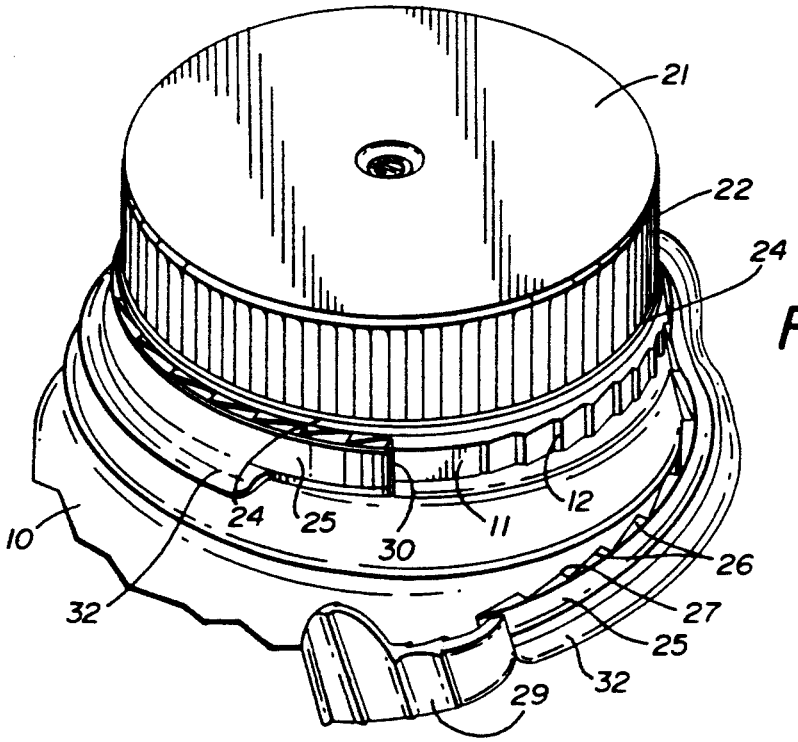
FIG. 5 is a perspective view of the cap of FIGS. 3 and 4 of the drawings positioned on the upper portion of the container of FIG. 1 of the drawings with a portion of a combined tear skirt and flexible ratchet strip partially torn away therefrom.

As illustrated in FIG. 5 of the drawings, the push on pull off tamper indicating flexible cap is illustrated engaged on the neck finish of the tubular portion 13 of the neck of the container. The tear skirt 25 is illustrated partially separated from the annular depending wall 22 of the cap wherein the continuous ratchet teeth 26 are separated from their engagement with the lower peripheral edge of the narrow outturned rib 24 which defines the lower edge of the annular depending wall 22. The continuous ratchet teeth 26 of the flexible tear skirt 25 are shown partially disengaged from one of the two groups of ratchet teeth comprising the fastening configurations 12 on the neck 11 of the container 10. In order that the continuous ratchet strip comprising the tear skirt 25 be freed from the remainder of the cap as shown in FIG. 5, a pull tab 29 is freed from a vertical tear line 30 and moved outwardly as illustrated.

It will occur to those skilled in the art that by removing the tear skirt 25 completely, it is necessary to break away each of the connecting members 27 which are formed by the innermost upper corners of each of the ratchet teeth 26 which are closely circumferentially spaced with respect to one another and provide a very durable connection that is not subject to accidental tearing during the handling of the cap as in installing the same on the neck of a blow molded jug or the like.

By referring again to FIGS. 1 and 3 of the drawings, it will be seen that the tear skirt 25 which comprises the elongated ratchet strip with the ratchet teeth 26 is joined at one of its ends 31 to the tear tab 29 and its other end 30 terminates in the vertical tear line 30. The tear skirt 25 in its as formed and in use position as best seen in FIG. 3 of the drawings is positioned vertically and it will also be seen that its lower edge is provided with an outturned flange 32 which will engage and rest on the portion of the blow molded jug 10 immediately below the neck portion 11.

It will thus be seen that the push on or screw on pull off tamper indicating flexible cap for blow molded jugs or the like disclosed herein has several points of novelty by reason of the continuous ratchet teeth configurations formed by the ratchet teeth 26 on the inner surface of the tear skirt 25 of the cap and the attachment of the tear skirt 25 to the lower surface of the outturned narrow rib 24 which comprises the slightly widened lower edge of the annular depending wall 22 of the cap. This results in an unusual and novel large plurality of very small frangible connections between the upper innermost corners 27 of the ratchet teeth 26 of the continuous ratchet configuration of the inner side of the tear skirt 25.

It will thus be seen that a substantially changed and improved neck finish on a blow molded jug or the like and a flexible push on pull off or twist on-twist off cap have been illustrated and described.

I claim:

1. A container having a neck surrounding an opening therein, said neck having a first portion of a known diameter, a plurality of vertical fastening configurations on the exterior of said first portion, a cylindrical neck portion of a lesser diameter than said known diameter, said cylindrical neck portion extending vertically above said first portion to said opening, seven circumferentially and vertically spaced continuous spiral thread configurations on said cylindrical neck portion, where said continuous spiral thread configurations each extend for more than a complete spiral circle, each of said spiral thread configurations having uppermost ends defining circumferentially spaced lead-in points so as to form multiple means for registering engagement with a flexible cap having a depending annular wall and seven circumferentially and vertically spaced continuous spiral thread configurations on the inner surface of said depending annular wall of said cap, each thread configuration having a first end and a second end, said second end circumferentially and axially spaced from said first end, and a tear skirt depending from said depending annular wall, means on said tear skirt engaging said plurality of vertical fastening configurations.

2. The container of claim 1 wherein said cylindrical neck portion has an upper end surrounding said opening and said lead-in points of said spaced continuous spiral threads are positioned adjacent said upper end.

3. The container of claim 1 wherein said vertical fastening configurations on said first portion of said neck comprise groups of ratchet teeth arranged for engaging registry with continuous ratchet teeth formed on the inner surface of said tear skirt of said flexible cap so as to prevent rotation of said cap on said first portion of said container neck.

4. In the combination of a container and a closure therefor wherein the container has a cylindrical neck surrounding an opening therein, said neck having a first portion of a known diameter and a portion thereabove of a lesser diameter than said known diameter, the neck portion of said known diameter having ratchet sections and the neck portion of lesser diameter thereabove having seven circumferentially and vertically spaced annular spiral thread configurations thereon, each of said circumferentially and vertically spaced annular spiral thread configurations forming a continuous thread, where said continuous thread extends for more than a complete spiral circle, each of said continuous thread configurations having an upper end and a lower end, said lower end circumferentially and axially spaced from said upper end, with the upper ends of each of said threads forming circumferentially spaced lead-in points for the reception of said closure having a top, an annular depending wall on said top, seven circumferentially and vertically spaced continuous annular spiral thread configurations on the inner surface of said annular depending wall engageable with said annular continuous spiral thread configurations on said neck portion of lesser diameter.

5. The combination of claim 4 wherein said annular depending wall is of a known diameter, a tear skirt of a greater diameter than said annular depending wall diameter and depending from said annular depending wall, continuous ratchet teeth on said tear skirt arranged to engage said ratchet sections on said neck portion of known diameter so as to prevent rotation of said closure on said neck.

* * * * *